United States Patent [19]

Brammer

[11] 4,407,418

[45] Oct. 4, 1983

[54] ADJUSTABLE TIE RACK

[76] Inventor: John W. Brammer, 27622 Parkview Blvd., Apt. #323, Warren, Mich. 48092

[21] Appl. No.: 267,786

[22] Filed: May 28, 1981

[51] Int. Cl.[3] ..... A47F 7/12

[52] U.S. Cl. ..... 211/87; 108/28; 211/94; 248/298

[58] Field of Search ..... 211/94, 87, 86, 162, 211/105.1, 46, 113; 108/28, 29; 248/298

[56] References Cited

U.S. PATENT DOCUMENTS

| | | | |
|---|---|---|---|
| 1,050,235 | 1/1913 | Scanlan | 248/298 X |
| 1,687,383 | 10/1928 | O'Neil | 108/28 |
| 2,655,268 | 10/1953 | Whaley | 108/29 UX |
| 2,720,316 | 10/1955 | Glascott | 108/28 |
| 2,908,471 | 10/1959 | Hollansworth | 211/105.1 X |
| 2,963,253 | 12/1960 | Maier et al. | 248/298 |
| 2,985,311 | 5/1961 | Abel | 211/86 |
| 4,104,972 | 8/1978 | Baublitz | 211/86 X |
| 4,126,231 | 11/1978 | Derwent-Wryde | 108/29 X |

FOREIGN PATENT DOCUMENTS

| | | | |
|---|---|---|---|
| 653998 | 5/1951 | United Kingdom | 211/94 |

*Primary Examiner*—Ramon S. Britts
*Assistant Examiner*—Robert W. Gibson, Jr.
*Attorney, Agent, or Firm*—Barnes, Kisselle, Raisch, Choate, Whittemore & Hulbert

[57] ABSTRACT

A support rack for ties, belts and the like for use in clothes closets and to be supported under a closet shelf. The rack has alternate forward ends selectively used to engage a shelf rim or support pole, and a rearward end to be supported at a closet wall. The rack is adjustably extensible to fit shelves of varying widths. The rack is designed to be formed of sheet metal easily assembled and adjusted to installation.

8 Claims, 9 Drawing Figures

ADJUSTABLE TIE RACK

FIELD OF THE INVENTION

Tie racks to be used in clothes closets below a horizontal shelf, the support coming partly from the shelf and partly from the vertical wall of a closet.

BACKGROUND OF THE INVENTION

Tie racks of various designs have been used in closets, most of them having a single wall bracket for support, sometimes with a swinging arm to support ties. Examples are shown in U.S. patents to Whaley, No. 2,655,268 (Oct. 13, 1953) and Wilmoth, No. 3,688,912 (Sept. 5, 1972). Since the bracket must be supported on a plaster wall or a wall board wall, it is difficult to get screws to hold in the wall without special expansion bolts or plastic expansion sockets. Even then the leverage exerted by the ties, plus accidental striking of the rack will cause the screws to work loose in the wall.

The present invention is adapted to be used with closet sheves forming a part of the support. In many modern homes, the closet shelves are formed of sheet metal with a frontal skirt which is turned in to provide a coat hanger hook support, or with a wooden or metal tube pole supported horizontally below the front edge of the shelf. The invention is designed selectively to cooperate with either type of shelf and is supported at the forward edge by the shelf and rearwardly by a wall bracket. Thus, the bracket is braced against the wall and has only a shear force on the supporting screws which can adequately resist the vertical forces on the rack.

The rack is of simple sheet metal construction and adjustable lengthwise to adapt to various shelves and installations. It is designed to be readily installed by the average householder.

Other objects and features of the invention will be apparent in the following description and claims in which the invention is described together with details to enable a person skilled in the art to make and use the device.

BRIEF DESCRIPTION OF THE DRAWINGS

DRAWINGS accompany the disclosure and the various views thereof may be briefly described as.

DETAILED DESCRIPTION OF THE INVENTION AND THE MANNER OF MAKING AND USING IT

Figure 1:
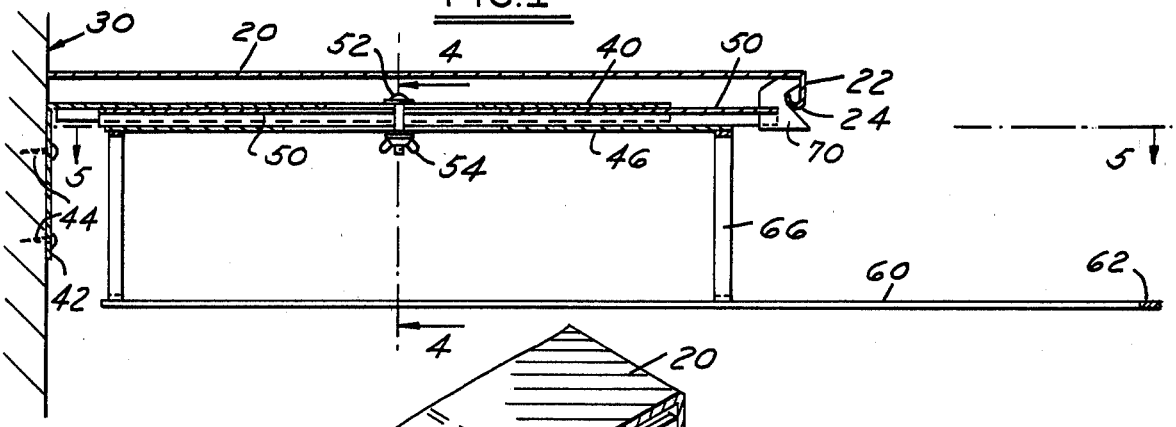
FIG. 1, a side view of the device partially in section.

WITH REFERENCE TO THE DRAWINGS, in FIG. 1, a closet shelf is shown with a sheet metal top plate 20 and a from skirt or return edge 22 having an inturned clothes hanger portion 24. This shelf is supported on a vertical wall 30 of traditional construction, i.e., plaster or wall board.

The tie rack of the present invention comprises a top plate 40 which has at one end a downturned tab or wall plate 42 to be scrwed to the wall by screws 44. The top plate has angled side flanges 45. A bottom plate 46 has upturned edges 48 which serve as guides or stabilizers for the top plate. These plates are slidable longitudinally of each other. In the embodiment of FIG. 1, a spacer plate 50 is provided having downturned edges separating plates 40 and 46. All of these plates are slotted longitudinally to receive a headed bolt 52 which transfixes the plates and carries a thumb nut 54. Thus, the bottom plate 46 is longitudinally adjustable relative to the top plate 40. The spacer plate 50 holds the edges 45 of plate 40 up from the plate 46.

Figure 4:
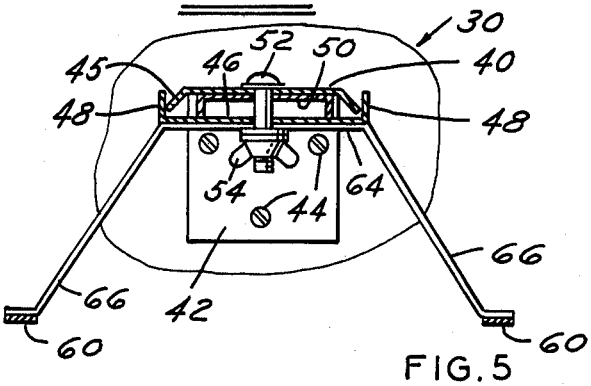
FIG. 4, a transverse sectional view on line 4—4 of FIG. 1.
Figure 5:
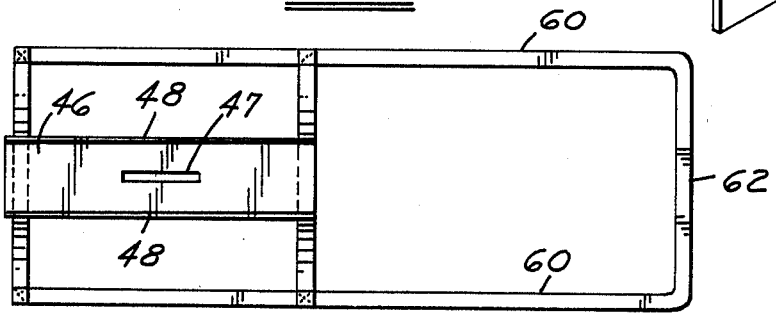
FIG. 5, a view on line 5—5 of FIG. 1.

The plate 46 is shown in plan in FIG. 5. A U-shaped tie support frame is also shown in this view with legs 60 and a bight portion 62. As shown best in FIG. 4, two V-shaped brackets having a cross-base 64 and diverging legs 66 are fastened at the cross-base 64 to the bottom plate 46 by spot welds or any other acceptable means. The legs 60 are spot welded to short extensions on the legs 66 so that the frame 60–62 is suspended horizontally under and spaced from the shelf.

Figure 2:
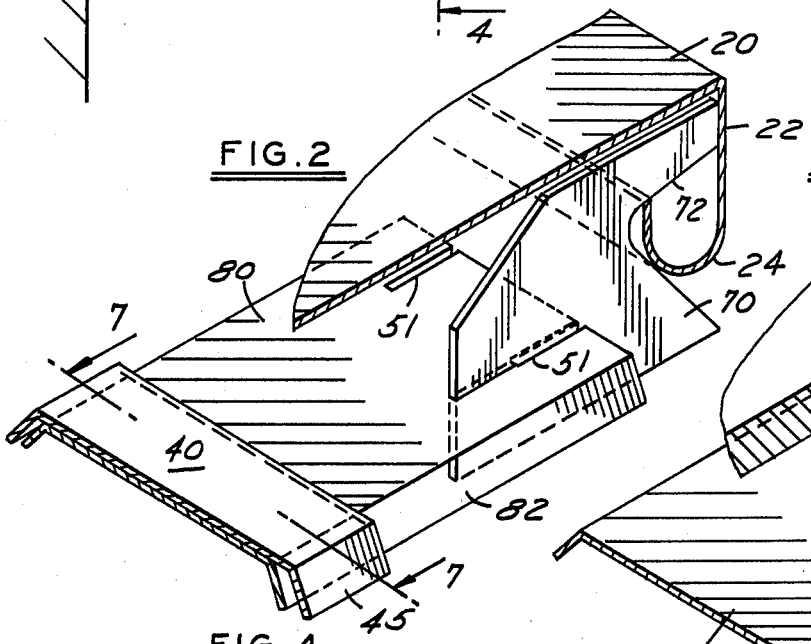
FIG. 2, a perspective view of a modified support assembly on a shelf with an inturned skirt.
Figure 6:
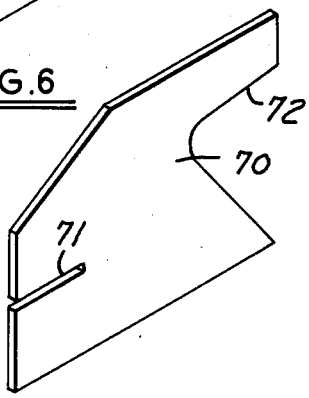
FIG. 6, a perspective view of a front support plate.

Intermediate plate 50, slidable relative to top plate 40, has longitudinal slots 51 extending inwardly from the free end to receive suspension plates 70 also slotted at 71 at the rear edges. These slots interengage as shown in FIG. 2 although FIG. 2 is a modified embodiment. Plates 70 have a forward notch 72 which receives the inturned portion 24 on shelf 20. A single plate 70 is shown in FIG. 6.

Figure 3:
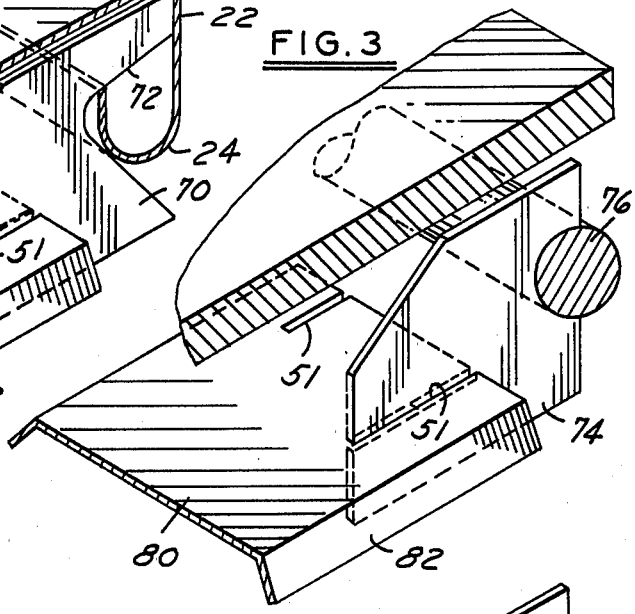
FIG. 3, a perspective view for use with a shelf having a pole support.

In FIG. 3, a modified plate 72 is shown to receive a clothes pole 76 adjacent the front of the shelf.

When installing the device, the plates 40 and 50 can be placed under the shelf 20 and the plates 70 engaged with the shelf edge. The wall bracket plate 45 is pressed against wall 30 and screws 44 driven into the wall. Thus, the assembly is solidly supported at each end and there is only a shear force on the screws and no leverage or torsion forces.

The plate 46, being slotted at 47 (FIG. 5), can be adjusted to position the frame 60–62 in or out relative to the support assembly. The legs 60 and front bar 62 will support neckties or belts either directly or on plastic hangers which are sometimes furnished when neckties are purchased.

Figure 7:
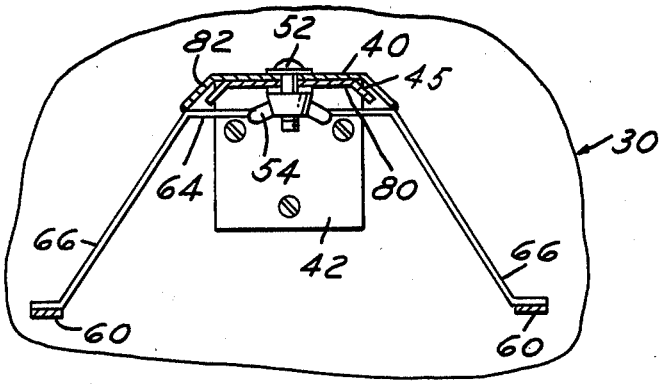
FIG. 7, a section of a modified construction taken on line 7—7 of FIG. 2.

In FIGS. 2 and 7, a modified support assembly is illustrated with two plates. As upper plate 40 is similar to that shown in FIG. 1 with the wall tab 42. A lower plate 80 has angled side guide flanges 82 and these plates are slotted and retained by a thumb screw similar to that shown in FIG. 4. In this embodiment, the cross bracket 64 between legs 66 are fastened directly to the edges 45 of plate 40 and no spacer is used between the plates.

In FIG. 3, the embodiment of FIG. 2 is shown with a pole engaging plate 74. Plates 70 and 74 would preferably be used in pairs in the two slots provided at the forward ends of plates 50 and 80.

Figure 8:
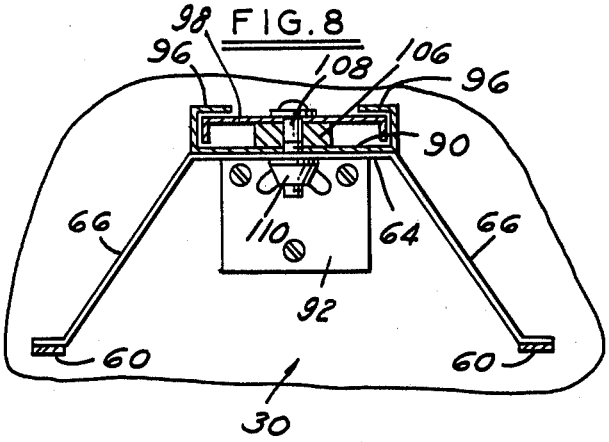
FIG. 8, a section of a yet another modification.
Figure 9:
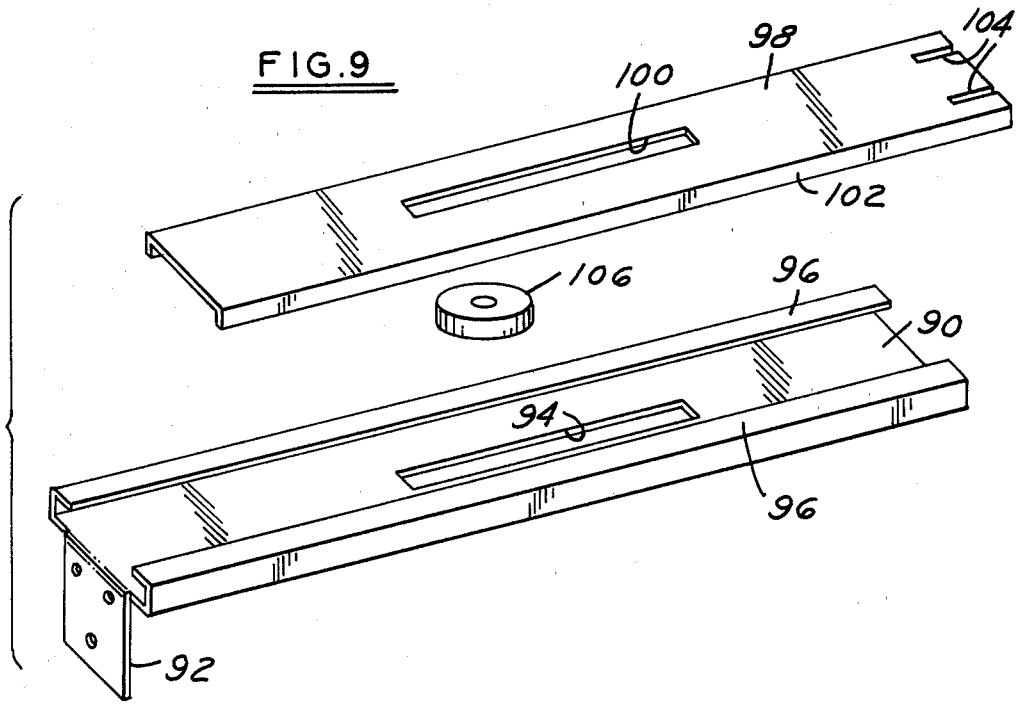
FIG. 9, a perspective view of the parts of the embodiment sectioned in FIG. 8.

In FIGS. 8 and 9, another modification is illustrated having base strip 90 with a downward wall plate 92 and provided with an elongate slot 94. The side edges of strip 90 are bent upwardly and inwardly to form an inturned flange 96 which, in conjunction with the strip 90, forms guide grooves for a slide plate 98 having an elongate slot 100 and downturned edges 102. The plate 98 has end slots 104 to receive plates 70 or 74. A spacer stud 106 is transfixed by a bolt 108 when located between strip 90 and plate 98. A thumb nut 110 holds the parts together in an adjusted position. This embodiment functions in the same manner as those previously described. Cross base 64 is secured to the bottom of base strip 90 and supports the diverging legs 66 which hold the support frame 60–62.

What I claim is:

1. A support rack for use under a horizontal closet shelf having a clothes hanger support near the front edge which comprises:

(a) a first elongate plate having a tab to fasten to a closet wall, (b) a second elongate plate adjustably slidable in relation to said first plate, (c) means on said second plate to engage and be supported by a clothes hanger support, (d) means to lock said plates in a longitudinally adjusted position, and (e) a frame suspended from one of said plates having legs parallel to and below said elongate plates to support ties and the like.

2. A support rack as defined in claim 1 in which said frame comprises a U-shaped member having legs spaced downwardly and outwardly from said elongate plates and a bight member connecting said legs.

3. A support rack as defined in claim 1 in which side flanges on at least one of said plates serve to locate and guide said plates relative to each other.

4. A support rack as defined in claim 1 in which each of said plates has edge flanges to interengage transversely of said plates to locate and guide said plates relative to each other.

5. A support rack as defined in claim 4 in which a spacer is interposed between said plates to separate said plates vertically.

6. A support rack for use under a horizontal closet shelf having a clothes hanger support near the front edge which comprises:

(a) a first elongate plate having a tab to fasten to a closet wall, (b) a second elongate plate adjustably slidable in relation to said first plate, (c) means on said second plate to engage and be supported by a clothes hanger support, (d) means to lock said plates in a longitudinally adjusted position, (e) a frame suspended from one of said plates having legs parallel to and below said elongate plates to support ties and the like, said frame comprising a U-shaped member having legs spaced downwardly and outwardly from said elongate plates and a bight member connecting said legs, and (f) V-shaped brackets suspending said frame, the base of the V being fastened to said second plate, and the digital ends of the legs of the V being fastened to the legs of the frame.

7. A support rack for use under a horizontal closet shelf having a clothes hanger support near the front edge which comprises:

(a) a first elongate plate having a tab to fasten to a closet wall, (b) a second elongate plate adjustably slidable in relation to said first plate, (c) means on said second plate to engage and be supported by a clothes hanger support, (d) means to lock said plates in a longitudinally adjusted position, (e) a frame suspended from one of said plates having legs parallel to and below said elongate plates to support ties and the like, said frame comprising a U-shaped member having legs spaced downwardly and outwardly from said elongate plates and a bight member connecting said legs, and (f) V-shaped brackets suspending said frame, the base of the V being fastened to said first plate, and the digital ends of the legs of the V being fastened to the legs of the frame.

8. A support rack for use under a horizontal closet shelf having a clothes hanger support near the front edge which comprises:

(a) a first elongate plate having a tab to fasten to a closet wall, (b) a second elongate plate adjustably slidable in relation to said first plate, (c) means on said second plate to engage and be supported by a clothese hanger support, (d) means to lock said plates in a longitudinally adjusted position, and (e) a frame suspended from one of said plates having legs parallel to and below said elongate platesl to support ties and the like, said second plate being slotted at the free end and a plurality of plates to engage and be supported in said slots, said plates being selectively used for support engagement with a shelf flange and a closet pole at the outer edge of a shelf.

* * * * *